US007670678B2

(12) United States Patent
Phan

(10) Patent No.: US 7,670,678 B2
(45) Date of Patent: Mar. 2, 2010

(54) FIBERS COMPRISING HEMICELLULOSE AND PROCESSES FOR MAKING SAME

(75) Inventor: Dean Van Phan, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 276 days.

(21) Appl. No.: 11/931,440

(22) Filed: Oct. 31, 2007

(65) Prior Publication Data

US 2008/0154225 A1 Jun. 26, 2008

Related U.S. Application Data

(60) Provisional application No. 60/875,933, filed on Dec. 20, 2006.

(51) Int. Cl.
*D02G 3/00* (2006.01)

(52) U.S. Cl. ..... 428/393; 106/162.5

(58) Field of Classification Search ..... 428/393, 428/373; 106/162.5, 162.51; 536/56
See application file for complete search history.

(56) References Cited

U.S. PATENT DOCUMENTS

| | | | | |
|---|---|---|---|---|
| 2,523,708 | A | 9/1950 | Owen | |
| 3,325,472 | A | 6/1967 | Sackler et al. | |
| 3,679,658 | A | 7/1972 | Yueh et al. | |
| 3,846,403 | A | 11/1974 | Gibney et al. | |
| 4,761,203 | A * | 8/1988 | Vinson | 162/9 |
| 6,183,865 | B1 * | 2/2001 | Yabuki et al. | 428/393 |
| 6,306,334 | B1 * | 10/2001 | Luo et al. | 264/561 |
| 6,440,523 | B1 * | 8/2002 | Sealey et al. | 428/93 |
| 6,491,788 | B2 * | 12/2002 | Sealey et al. | 162/65 |
| 6,528,163 | B2 * | 3/2003 | Sealey et al. | 428/393 |
| 6,605,350 | B1 * | 8/2003 | Sealey et al. | 428/393 |
| 6,692,827 | B2 * | 2/2004 | Luo et al. | 428/369 |
| 6,852,413 | B2 * | 2/2005 | Lee et al. | 428/393 |
| 6,881,252 | B2 * | 4/2005 | Skuratowicz | 106/162.5 |
| 7,390,566 | B2 * | 6/2008 | Luo et al. | 428/393 |
| 2004/0046277 | A1 | 3/2004 | Buerger et al. | |

FOREIGN PATENT DOCUMENTS

| | | | |
|---|---|---|---|
| CN | 1 356 416 | A | 7/2002 |
| CN | 1 693 553 | A | 11/2005 |
| DE | 1108198 | B | 6/1961 |
| EP | 406 685 | A1 | 1/1991 |
| GB | 723630 | A | 2/1955 |
| JP | 59 179814 | A | 10/1984 |
| JP | 2003 253524 | A | 9/2003 |
| WO | WO 2006/072119 | A2 | 7/2006 |

OTHER PUBLICATIONS

International Search Report, Mailed Dec. 14, 2008.
Carson, et al., "Esters of Lima Bean Pod and Corn Cob Hemicelluloses", *Journal of the American Chemical Society*, vol. 70, pp. 293-295, (1948).
Greffe, et al., "Synthesis, Preliminary Characterization, and Application of Novel Surfactants from Highly Branched Xyloglucan Oligosaccharides", *Glycobiology*, vol. 15, No. 4, pp. 437-445 (2005).

* cited by examiner

*Primary Examiner*—N. Edwards
(74) *Attorney, Agent, or Firm*—C. Brant Cook

(57) ABSTRACT

Hemicellulose fibers, more particularly to non-naturally occurring fibers incorporating hemicellulose, processes for making same and fibrous structures incorporating same are provided.

20 Claims, 2 Drawing Sheets

FIBERS COMPRISING HEMICELLULOSE AND PROCESSES FOR MAKING SAME

CROSS REFERENCE TO RELATED APPLICATIONS

This application claims the benefit of U.S. Provisional Application No. 60/875,933 filed Dec. 20, 2006.

FIELD OF THE INVENTION

The present invention relates to fibers comprising hemicellulose, more particularly to non-naturally occurring fibers comprising hemicellulose, processes for making same and fibrous structures incorporating same.

BACKGROUND OF THE INVENTION

Non-naturally occurring fibers have been explored by formulators for decades. For example, non-naturally occurring cellulose fibers, such as lyocell and/or rayon, have been used in textile applications. Further, non-naturally occurring cellulose derivative fibers, such as cellulose acetate and/or cellulose fatty acid ester fibers, have also been used in textile applications.

Further, non-naturally occurring fibers comprising mainly cellulose, such as lyocell, have been taught in the art as also comprising up to 27% hemicellulose. However, the prior art has failed to teach a non-naturally occurring fiber comprising greater than 30% by weight on a dry fiber basis of hemicellulose and/or non-naturally occurring fibers comprising mainly hemicellulose.

However, the costs, processing complexities and properties of these cellulose and/or cellulose derivative fibers have made the use of such fibers in non-textile fibrous structures, such as paper towels, bath tissue, facial tissue and/or wipes, less attractive.

Accordingly, there is a need for a non-naturally occurring fiber that is suitable and cost effective for inclusion in non-textile fibrous structures, especially sanitary tissue products, processes for making such non-naturally occurring fibers, fibrous structures comprising such non-naturally occurring fibers and sanitary tissue products comprising such fibrous structures.

SUMMARY OF THE INVENTION

The present invention fulfills the needs described above by providing a non-naturally occurring fiber comprising hemicellulose, a process for making such a fiber, a fibrous structure comprising such a fiber, and a sanitary tissue product comprising such a fibrous structure.

In one example of the present invention, a non-naturally occurring fiber comprising greater than 30% by weight on a dry fiber basis of hemicellulose is provided.

In another example of the present invention, a fibrous structure comprising one or more of the non-naturally occurring hemicellulose fibers according to the present invention is provided.

In yet another example of the present invention, a single- or multi-ply sanitary tissue product comprising one or more fibrous structures according to the present invention is provided.

In even another example of the present invention, a process for making a non-naturally occurring fiber, the process comprising the step of producing a fiber comprising greater than 30% by weight on a dry fiber basis of hemicellulose is provided.

Accordingly, the present invention provides a non-naturally occurring fiber comprising hemicellulose, a process for making such a fiber, a fibrous structure comprising such a fiber and a sanitary tissue product comprising such a fibrous structure.

DETAILED DESCRIPTION OF THE INVENTION

Definitions

Figure 1:
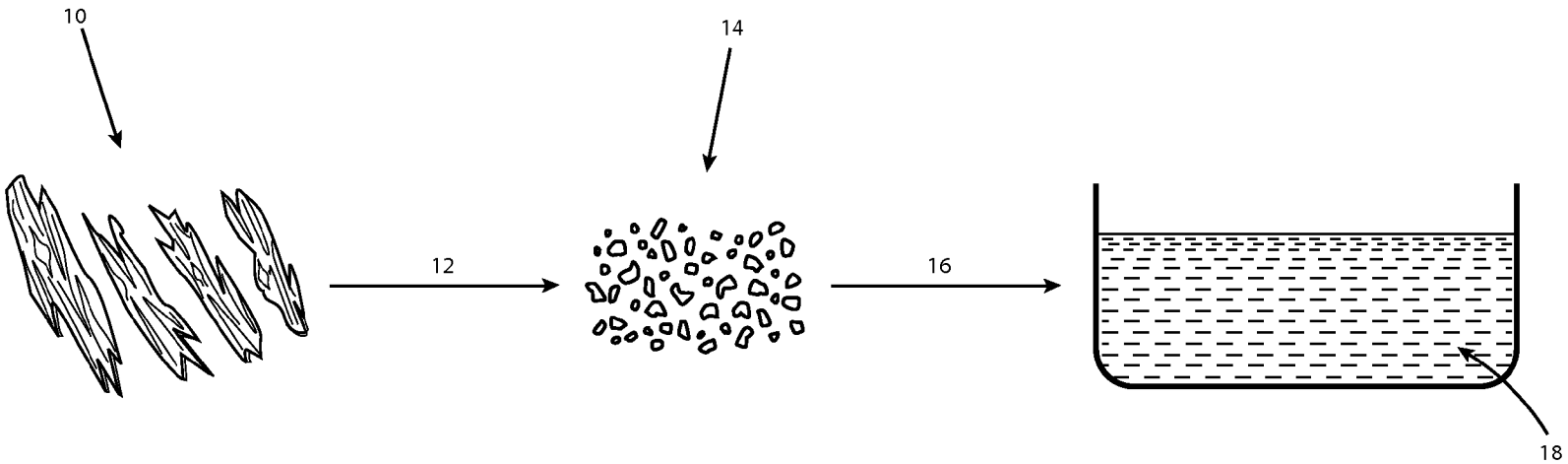
FIG. 1 is a schematic representation of one example of a process for solubilizing a raw material source of hemicellulose.

"Hemicellulose" as used herein means any of several polysaccharides that are more complex than a sugar and less complex than cellulose. Nonlimiting examples of sugar and/or sugar acid units found in hemicellulose include one or more of the following: pentoses, such as xylose, arabinopyranose and arabinofuranose; hexoses, such as glucose, mannose and galactose; hexuronic acids, such as glucuronic acid, methylglucuronic acid and galacturonic acid; and deoxy-hexoses, such as rhamnose and fucase. In one example, the hemicellulose of the present invention comprises a polysaccharide comprising a monomer selected from the group consisting of: D-glucose, D-glucuronic acid, D-mannose, D-arabinose, D-xylose, D-xylopyranose, D-glucopyranose, D-galactopyranose, L-arabinofuranose, D-mannopyranose, D-glucopyranosyluronic acid, β-D-xylose, β-D-glucose, β-D-glucuronic acid, β-D-mannose, α-L-rhamnose, α-L-arabinopyranose, α-L-fucase, α-L-arabinofuranose, α-D-4-O-methylglucuronic acid, α-D-galactose, α-D-galacturonic acid and mixtures thereof.

In one example, the hemicellulose of the present invention includes a polysaccharide selected from the group consisting of: xylan, glucuronoxylan, arabinoxylan, glucomannan, galactoglucomannan, xyloglucan and mixtures thereof.

A hemicellulose of the present invention may exhibit a degree of polymerization of less than about 2000 and/or less than about 1000 and/or less than about 500 and/or less than about 250 and/or less than about 100 to about 1 and/or to about 20 and/or to about 50. In one example, a hemicellulose of the present invention exhibits a degree of polymerization of from about 20 to about 100 and/or from about 20 to about 500 and/or from about 20 to about 250 and/or from about 50 to about 250 and/or from about 20 to about 100 and/or from about 50 to about 100.

A hemicellulose of the present invention may exhibit a weight average molecular weight of less than about 340,000 g/mol and/or less than about 300,000 g/mol and/or less than about 200,000 g/mol and/or less than about 100,000 g/mol and/or less than about 70 g/mol and/or less than about 50 g/mol and/or less than about 30,000 g/mol and/or less than about 20,000 g/mol and/or from less than about 15,000 g/mol to about 500 g/mol and/or to about 1,000 g/mol and/or to about 5,000 g/mol.

A hemicellulose of the present invention may be obtained from a wood source, such as wood pulp, and/or from a non-wood source. Hemicellulose may be obtained from wood pulp from hardwood trees, such as tropical hardwood trees, for example eucalyptus and/or acacia trees. Hemicellulose may be obtained from wood pulp from softwood trees, such as northern softwood trees and/or southern softwood trees. Non-limiting examples of non-wood sources of hemicellulose include corn hulls and/or corn brans.

"Non-naturally occurring" as used herein with respect to "non-naturally occurring fiber" means that the fiber is not found in nature in that form. In other words, some chemical processing of materials needs to occur in order to obtain the non-naturally occurring fiber. For example, a wood pulp fiber is a naturally occurring fiber, however, if the wood pulp fiber is chemically processed, such as via a lyocell-type process, a solution of cellulose is formed. The solution of cellulose may then be spun into a fiber. Accordingly, this spun fiber would be considered to be a non-naturally occurring fiber since it is not directly obtainable from nature in its present form.

"Naturally occurring" as used herein means that a fiber and/or a material is found in nature in its present form. An example of a naturally occurring fiber is a wood pulp fiber.

A "fibrous structure" as used herein means a single web structure that comprises at least one hemicellulose fiber. For example, a fibrous structure of the present invention may comprise one or more fibers, wherein at least one of the fibers comprises a hemicellulose fiber, such as a non-naturally occurring hemicellulose fiber. In another example, a fibrous structure of the present invention may comprise a plurality of fibers, wherein at least one (sometimes a majority, even all) of the fibers comprises a hemicellulose fiber, such as a non-naturally occurring hemicellulose fiber. The fibrous structures of the present invention may be layered such that one layer of the fibrous structure may comprise a different composition of fibers and/or materials from another layer of the same fibrous structure.

"Fiber" as used herein means a slender, thin, and highly flexible object having a major axis which is very long, compared to the fiber's two mutually-orthogonal axes that are perpendicular to the major axis. Preferably, an aspect ratio of the major's axis length to an equivalent diameter of the fiber's cross-section perpendicular to the major axis is greater than 100/1, more specifically greater than 500/1, and still more specifically greater than 1000/1, and even more specifically, greater than 5000/1.

The fibers of the present invention may be continuous or substantially continuous. A fiber is continuous if it extends 100% of the MD length of the fibrous structure and/or fibrous structure and/or sanitary tissue product made therefrom. In one example, a fiber is substantially continuous if it extends greater than about 30% and/or greater than about 50% and/or greater than about 70% of the MD length of the fibrous structure and/or sanitary tissue product made therefrom. In another example, continuous or substantially continuous fiber in accordance with the present invention may exhibit a length of greater than 3.81 cm (1.5 inches).

The fiber can have a fiber diameter as determined by the Fiber Diameter Test Method described herein of less than about 100 microns and/or less than about 50 microns and/or less than about 20 microns and/or less than about 10 microns and/or less than about 8 microns and/or less than about 6 microns to about 1 micron and/or to about 2 microns and/or to about 3 microns.

The fibers may include melt spun fibers, dry spun fibers and/or spunbond fibers, staple fibers, hollow fibers, shaped fibers, such as multi-lobal fibers and multicomponent fibers, especially bicomponent fibers. The multicomponent fibers, especially bicomponent fibers, may be in a side-by-side, sheath-core, segmented pie, ribbon, islands-in-the-sea configuration, or any combination thereof. The sheath may be continuous or non-continuous around the core. The ratio of the weight of the sheath to the core can be from about 5:95 to about 95:5. The fibers of the present invention may have different geometries that include round, elliptical, star shaped, rectangular, trilobal and other various eccentricities.

"Sanitary tissue product" as used includes but is not limited to a wiping implement for post-urinary and post-bowel movement cleaning (toilet tissue), for otorhinolaryngological discharges (facial tissue), and multi-functional absorbent, cleaning uses (absorbent towels), wipes, feminine care products and diapers.

A sanitary tissue product of the present invention comprises at least one fibrous structure in accordance with the present invention. In one example, a fibrous structure and/or sanitary tissue product according to the present invention exhibits an initial total wet tensile of at least about 8 g/2.54 cm (8 g/in) and/or at least about 10 g/2.54 cm (10 g/in) and/or at least about 15 g/2.54 cm (15 g/in) and/or at least about 20 g/2.54 cm (20 g/in) and/or at least about 40 g/2.54 cm (40 g/in).

In another example, a fibrous structure and/or a sanitary tissue product of the present invention exhibits an initial total wet tensile, of less than about 500 g/2.54 cm (500 g/in) and/or less than about 400 g/2.54 cm (400 g/in) and/or less than about 300 g/2.54 cm (300 g/in) and/or less than about 200 g/2.54 cm (200 g/in) and/or less than about 150 g/2.54 cm (150 g/in) and/or less than about 120 g/2.54 cm (120 g/in) and/or less than about 100 g/2.54 cm (100 g/in).

In yet another example, a fibrous structure and/or a sanitary tissue product of the present invention may exhibit an initial total wet tensile of from about 8 g/2.54 cm (8 g/in) to about 500 g/2.54 cm (500 g/in) and/or from about 40 g/2.54 cm (40 g/in) to about 500 g/2.54 cm (500 g/in) and/or from about 60 g/2.54 cm (60 g/in) to about 500 g/2.54 cm (500 g/in) and/or from about 65 g/2.54 cm (65 g/in) to about 450 g/2.54 cm (450 g/in) and/or from about 70 g/2.54 cm (70 g/in) to about 400 g/2.54 cm (400 g/in) and/or from about 75 g/2.54 cm (75 g/in) to about 400 g/2.54 cm (400 g/in) and/or from about 80 g/2.54 cm (80 g/in) to about 300 g/2.54 cm (300 g/in) and/or from about 80 g/2.54 cm (80 g/in) to about 200 g/2.54 cm (200 g/in) and/or from about 80 g/2.54 cm (80 g/in) to about 150 g/2.54 cm (150 g/in) and/or from about 80 g/2.54 cm (80 g/in) to about 120 g/2.54 cm (120 g/in) and/or from about 80 g/2.54 cm (80 g/in) to about 100 g/2.54 cm (100 g/in).

In one example, a fibrous structure and/or a sanitary tissue product according to the present invention exhibits a minimum total dry tensile of at least about 70 g/2.54 cm (70 g/in) and/or at least about 100 g/2.54 cm (100 g/in) and/or at least about 300 g/2.54 cm (300 g/in) and/or at least about 500 g/2.54 cm (500 g/in) and/or at least about 700 g/2.54 cm (700 g/in) and/or at least about 800 g/2.54 cm (800 g/in) and/or at least about 900 g/2.54 cm (900 g/in) and/or at least about 1000 g/2.54 cm (1000 g/in).

In another example, a fibrous structure and/or a sanitary tissue product according to the present invention exhibits a maximum total dry tensile of less than about 5000 g/2.54 cm (5000 g/in) and/or less than about 4000 g/2.54 cm (4000 g/in) and/or less than about 2000 g/2.54 cm (2000 g/in) and/or less than about 1700 g/2.54 cm (1700 g/in) and/or less than about 1500 g/2.54 cm (1500 g/in).

In even another example, a fibrous structure and/or a sanitary tissue product according to the present invention exhibits a wet lint score of less than about 25 and/or less than 20 and/or less than 15 and/or less than 10.

In yet another example, a sanitary tissue product according to the present invention exhibits a total dry tensile within a range of a minimum and maximum total dry tensile value as described above.

In still yet another example, a fibrous structure and/or a sanitary tissue product according to the present invention exhibits a Dry Lint Score of less than about 10 and/or less than about 8 and/or less than about 7 and/or less than about 6 and/or less than about 5.5.

In addition to sanitary tissue products, the fibrous structures of the present invention may be utilized in any number of various other applications known in the art. For example, in some examples, the fibrous structures may be utilized as packaging materials, wound dressings, etc.

"Ply" or "Plies" as used herein means a single fibrous structure optionally to be disposed in a substantially contiguous, face-to-face relationship with other plies, forming a multi-ply sanitary tissue product. It is also contemplated that a single fibrous structure can effectively form two "plies" or multiple "plies", for example, by being folded on itself. Ply or plies can also exist as films.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121. Unless otherwise specified, all molecular weight values herein refer to the weight average molecular weight.

Hemicellulose-Containing Composition a. Hemicellulose

The hemicellulose-containing composition of the present invention comprises hemicellulose. The hemicellulose-containing composition exhibits properties suitable for spinning the composition into one or more non-naturally occurring fibers. The hemicellulose-containing composition may contain an amount of hemicellulose that results in the non-naturally occurring fiber being produced from hemicellulose-containing composition containing greater than 30% and/or greater than 40% and/or greater than 50% and/or greater than 60% by weight on a dry fiber basis as determined by the Hemicellulose Detection Test Method and/or the Enzymatic Analysis Test Method described herein. In one example, the hemicellulose-containing composition may comprise from greater than about 1% and/or greater than about 5% and/or greater than about 10% and/or greater than about 20% and/or greater than about 30% and/or greater than about 40% and/or greater than about 50% and/or greater than about 60% and/or up to about 100% and/or up to about 99.85% and/or up to about 99% and/or up to about 97% and/or up to about 95% and/or up to about 90% and/or up to about 85% and/or up to about 80% by weight of the composition.

b. External Plasticizer

In addition to the hemicellulose, the balance of the hemicellulose-containing composition may comprise a plasticizer, such as an external plasticizer. A nonlimiting example of an external plasticizer suitable for inclusion in the hemicellulose-containing composition is a polar solvent. In one example, the external plasticizer is selected from the group consisting of: water, glycerine, polyethylene glycol, sorbitol, xylitol, mannitol and mixtures thereof.

In one example, the hemicellulose-containing composition comprises less than about 10% and/or less than about 5% and/or less than about 3% and/or less than about 1% and/or less than about 0.50% and/or less than about 0.25% and/or less than about 0.15% water to 0% and/or to about 0% by weight of the composition of an external plasticizer.

c. Additives

The hemicellulose-containing composition may comprise additives. The additives may be present in the raw material source from which the hemicellulose is obtained. In one example, upon processing the raw material source to solubilize the hemicellulose to form the hemicellulose-containing composition, other additives within the raw material source may remain with the newly formed hemicellulose-containing composition or may be removed from the hemicellulose-containing composition. Additives may alternatively or in addition, be added to the hemicellulose-containing composition as individual, discrete components.

One or more additives may be present in the hemicellulose-containing composition at a level of less than about 50% and/or less than about 40% and/or less than about 30% and/or less than about 20% and/or less than about 10% and/or to 0% and/or to about 0% and/or to about 0.5% and/or to about 1% and/or to about 2% and/or to about 4% by weight of the composition. Nonlimiting examples of additives include water-soluble and/or water-insoluble additives. Nonlimiting examples of suitable additives include cellulose, cellulose derivatives, acids, starch, starch derivatives, oils, proteins, protein derivatives, crosslinking agents, and high molecular weight polymers (greater than about 170,000 g/mol and/or greater than about 180,000 g/mol and/or greater than about 190,000 g/mol and/or greater than about 200,000 g/mol).

Nonlimiting examples of suitable high molecular weight polymers include alginate, polyacrylamide, carboxymethylcellulose, polyvinylalcohol, polylactic acid, polyhydroxyalkanoate.

In one example, the hemicellulose-containing composition comprises a non-hemicellulose hydroxyl polymer, such as a non-hemicellulose polysaccharide, for example cellulose and/or starch. The hydroxyl polymer may be a polysaccharide and/or a polyvinylalcohol.

In one example, the protein may be a gluten-based protein.

One or more additives, when present, may be soluble in the hemicellulose-containing composition. Alternatively, the additive may be insoluble, such as a solid particle, for example a microfibril, in the hemicellulose-containing composition. In another example, the additive may result in the hemicellulose-containing composition being phase separated, unless an emulsifying agent or the hemicellulose-containing composition is heated.

In one example, the additive may be a solid additive comprising an inorganic filler, such as clay.

d. Properties of Hemicellulose-Containing Composition

In one example, the hemicellulose-containing composition exhibits a shear viscosity according to the Shear Viscosity Test Method described herein of less than about 35 Pascal-Seconds and/or less than about 30 Pascal-Seconds and/or less than about 25 Pascal-Seconds and/or less than about 20 Pascal-Seconds and/or less than about 10 Pascal-Seconds and/or to about 0.5 Pascal-Seconds and/or to about 1 Pascal-Seconds and/or to about 2 Pascal-Seconds and/or to about 3 Pascal-Seconds as measured at a shear rate of 3,000 $sec^{-1}$ and at a temperature of between 50° C. to 100° C.

In another example, the hemicellulose-containing composition exhibits a Capillary Number of greater than 1 and/or greater than about 3 and/or greater than about 5 such that the hemicellulose-containing composition can be effectively processed into a non-naturally occurring hemicellulose fiber.

The Capillary number is a dimensionless number used to characterize the likelihood of a droplet of a composition breaking up. A larger capillary number indicates greater fluid stability upon exiting a die used to spin the composition into a non-naturally occurring fiber. The Capillary Number (Ca) is defined as follows:

$$Ca = \frac{V * \eta}{\sigma}$$

V is the fluid velocity at the die exit (units of Length per Time),

η is the fluid viscosity at the conditions of the die (units of Mass per Length*Time), σ is the surface tension of the fluid (units of mass per Time$^2$). When velocity, viscosity, and surface tension are expressed in a set of consistent units, the resulting Capillary Number will have no units of its own; the individual units will cancel out.

The Capillary Number is defined for the conditions at the exit of the die. The fluid velocity is the average velocity of the fluid passing through the die opening. The average velocity is defined as follows:

$$V = \frac{Vol'}{\text{Area}}$$

Vol'=volumetric flowrate (units of Length$^3$ per Time),

Area=cross-sectional area of the die exit (units of Length$^2$).

When the die opening is a circular hole, then the fluid velocity can be defined as $$V = \frac{Vol'}{\pi * R^2}$$

R is the radius of the circular hole (units of length).

The fluid viscosity will depend on the temperature and may depend of the shear rate. The definition of a shear thinning fluid includes a dependence on the shear rate. The surface tension will depend on the makeup of the fluid and the temperature of the fluid.

In one example of a fiber spinning process, the non-naturally occurring fibers need to exhibit an initial stability as they leave the die. The Capillary Number is used to characterize this initial stability criterion. At the conditions of the die, the Capillary Number should be greater than 1 and/or greater than about 3 and/or greater than about 5 and/or up to about 70 and/or up to about 60 and/or up to about 50.

In one example, the hemicellulose-containing composition exhibits a Capillary Number of from at least 1 to about 50 and/or at least 3 to about 50 and/or at least 5 to about 30.

Further, the hemicellulose-containing composition may exhibit a pH of from at least about 4 to about 12 and/or from at least about 4.5 to about 11.5 and/or from at least about 4.5 to about 11.

In one example, the hemicellulose-containing composition exhibits a temperature of from about 30° C. to about 190° C. and/or from about 35° C. to about 150° C. and/or from about 40° C. to about 130° C. and/or from about 40° C. to about 120° C.

In one example, the hemicellulose-containing composition is a homogeneous composition. In another example, the hemicellulose-containing composition is a homogeneous aqueous composition.

In another example, the hemicellulose-containing composition is a dispersion of solid additives, such as fibers or microfibrils, within an aqueous hemicellulose-containing solution or gel. The solid additives may comprise a non-hemicellulose polysaccharide, such as cellulose.

Hemicellulose Fiber

The hemicellulose-containing composition of the present invention, may be processed into a non-naturally occurring hemicellulose fiber by any suitable process known to those of ordinary skill in the art. Nonlimiting examples of suitable processes include meltblowing, spunbonding and solvent spinning. Nonlimiting examples of dies that can be used for spinning of the hemicellulose-containing composition into a fiber are known by those of skill in the art. One example of a suitable die is described in U.S. Pat. No. 7,018,188, which is incorporated herein by reference. One example of a suitable die manufacturer is Biax-Fiberfilm Corporation of Greenville, Wis.

In one example, the non-naturally occurring hemicellulose fiber of the present invention comprises greater than 30% and/or greater than about 40% and/or greater than about 50% and/or greater than about 60% and/or up to about 100% and/or up to about 95% and/or up to about 90% and/or up to about 85% and/or up to about 80% by weight on a dry fiber basis of hemicellulose.

In addition to hemicellulose, the non-naturally occurring hemicellulose fiber of the present invention may comprise additives, such as other polysaccharides, that were present in the hemicellulose-containing composition from which the non-naturally occurring fiber is produced. The cellulose may be in the form of microfibrils that provide reinforcement to the non-naturally occurring hemicellulose fiber.

The hemicellulose fiber of the present invention may exhibit a fiber diameter of less than about 100 microns and/or less than about 50 microns and/or less than 25 microns and/or less than about 20 microns and/or less than about 10 microns and/or less than about 8 microns and/or less than about 6 microns to about 1 micron and/or to about 2 microns and/or to about 3 microns as measured according to the Fiber Diameter Test Method.

Process for Making a Hemicellulose Fiber and Fibrous Structure a. Obtaining Hemicellulose The hemicellulose of the present invention may be obtained from any suitable source known to those of ordinary skill in the art. Nonlimiting examples of sources of hemicellulose include corn hulls, wood pulp obtained from hardwood trees, wood pulp obtained from softwood trees, non-wood sources, such as silk fibers, trichomes, seed hairs, cotton linters, cotton, algae, bast, grasses, corn hull, corn bran, corn cobs, cornstalks, wheat straw, kenaf, sorghum husk and tobacco. Oftentimes, the raw material source used to obtain the hemicellulose contains non-hemicellulose ingredients. An example of a non-hemicellulose ingredient comprises a polysaccharide such as starch and/or cellulose. For example, corn hulls contain hemicellulose, cellulose, starch, protein, oil, and soluble acids.

In one example, as shown in FIG. 1, a raw material source 10, such as corn hulls, is subjected to a grinding process, if necessary, to produce ground raw material 14. The ground raw material 14 is then subjected to a solubilization process 16. The solubilization process subjects that raw material to a moist, alkaline environment at a temperature of greater than about 40° C. and/or greater than about 50° C. and/or greater than about 60° C. and/or up to about 250° and/or up to about 200° C. and/or up to about 190° C. and/or up to about 180° C. and/or up to about 160° C. and/or up to about 140° C. The solubilization process 16 may be a jet cooking process. The alkaline environment may be provided by the presence of a base, for example calcium oxide, sodium hydroxide, ammonium hydroxide and calcium hydroxide. The solubilization process 16 results in the hemicellulose within the raw material source becoming soluble to form a hemicellulose-containing composition 18. The hemicellulose-containing composition 18 may be a homogeneous composition or it may contain solid particles, such as cellulosic fibers and/or cellulosic microfibrils, that are dispersed within the solubilized hemicellulose.

If the hemicellulose-containing composition 18 comprises solid particles (such as cellulosic fibers and/or cellulosic microfibrils), the solid particles may be treated with enzymes to become solubilized or to be removed prior to processing the hemicellulose-containing composition 18 into a fiber. Removal of the solid particles may be performed by any suitable process known to those in the art. For example, the hemicellulose-containing composition 18 may be subjected to a centrifugation process.

The hemicellulose-containing composition 18 may comprise additives, such as starch, protein, oils, acids, that are soluble or miscible in the hemicellulose-containing composition 18. Such additives may be removed by any suitable process known by those in the art. Alternatively, such additives or one or more of the additives may be retained in the hemicellulose-containing composition 18 such that it can become part of the non-naturally occurring hemicellulose fiber upon spinning the composition or it can be removed concurrently with the formation of the non-naturally occurring hemicellulose fiber.

b. Making a Hemicellulose-Containing Composition

The hemicellulose-containing composition 18 obtained by the process described in FIG. 1 can be used to spin non-naturally occurring hemicellulose fibers. However, additives may be added to the hemicellulose-containing composition.

If additives are desired to be added to the hemicellulose-containing composition, one or more additives can be added, as a solid (for example powder) or liquid form, directly to the hemicellulose-containing composition. In one example, the hemicellulose-containing composition comprises one or more additives and is in the form of a homogeneous composition.

In another example, one or more additives (for example an external plasticizer and/or a crosslinking agent) may be added to the hemicellulose-containing composition prior to, currently, and/or after the hemicellulose-containing composition has been spun into a non-naturally occurring hemicellulose fiber.

In general, any method known in the art for combining two or more different components would be suitable for adding the additives to the hemicellulose-containing composition. Typically such techniques include heating, mixing, and/or applying pressure. The particular order of mixing, temperatures, mixing speeds or time, and equipment can be varied, as will be understood by those skilled in the art, however temperature should be controlled such that the hemicellulose does not significantly degrade. In one example, an extruder, such as a twin-screw extruder may be used to make a hemicellulose-containing composition comprising one or more additives.

The hemicellulose within the hemicellulose-containing composition may be plasticized by a suitable plasticizer, such as an external plasticizer. In one example, a hemicellulose raw material may be plasticized, such as by water, in order to solubilize the hemicellulose raw material to form the hemicellulose-containing composition.

In one example, a solid plasticizer, such as sorbitol and/or mannitol, can be mixed with hemicellulose (in powder form) in an extruder to form a hemicellulose-containing composition. In another example, a liquid plasticizer such as glycerine and/or water can be mixed with hemicellulose (in powder form or liquid form) via volumetric displacement pumps.

In one example, the hemicellulose-containing composition is formed by subjecting hemicellulose raw material to a plasticizer, such as water, at a temperature of greater than about 40° C. for a time sufficient to plasticize the hemicellulose raw material.

In another example, the hemicellulose-containing composition may become gelatinized. For example, the hemicellulose-containing composition may be subjected to a temperature of from about 120° C. to about 180°, under shear, for a period of greater than about 10 seconds and/or to about 15 minutes such that the hemicellulose-containing composition gelatinizes.

In another example, all or a portion of any plasticizer, such as an external plasticizer, if any, present in the hemicellulose-containing composition may be removed prior to and/or concurrently with spinning the hemicellulose-containing composition into a non-naturally occurring fiber. One way to remove the plasticizer is by use of a vacuum that is applied to the hemicellulose-containing composition, such as when the composition is present in an extruder.

In another example, one or more additives may be added to the hemicellulose-containing composition for example via feed zones in an extruder comprising the hemicellulose-containing composition.

In one example, the hemicellulose-containing composition is plasticized sufficiently to a form capable of being spun into one or more fibers.

c. Processing the Hemicellulose-Containing Composition into a Non-Naturally Occurring Fiber The hemicellulose-containing composition described above may be processed into a non-naturally occurring hemicellulose fiber by any suitable method known to those of ordinary skill in the art. For example, the hemicellulose-containing composition may be subjected to a fiber spinning operation. Nonlimiting example of fiber spinning operations include spunbonding, melt blowing, continuous fiber producing and/or tow fiber producing, and/or solvent spinning.

Fiber spinning may be a dry spinning operation wherein a spinning composition is spun into air or some other gas or a wet spinning operation where the spinning composition is spun into a coagulating bath. One example of a dry spinning operation is a solvent spinning operation wherein a solvent-containing composition is processed into a fiber by spinning the composition and concurrently removing the solvent during fiber formation. The solvent may be eliminated from the hemicellulose-containing composition and/or non-naturally occurring fiber produced therefrom by volatilizing and/or diffusing it out of the composition and/or fiber.

In one example, a process for making a non-naturally occurring fiber comprises the step of producing a fiber comprising greater than 30% and/or greater than about 40% and/ or greater than about 50% and/or greater than about 60% and/or up to about 100% and/or up to about 95% and/or up to about 90% and/or up to about 85% and/or up to about 80% by weight on a dry fiber basis of hemicellulose. In another example, the step of producing a non-naturally occurring fiber comprising hemicellulose comprises spinning a hemicellulose-containing composition, which contains an amount of hemicellulose that results in the fiber being produced from the composition having greater than 30% and/or greater than about 40% and/or greater than about 50% and/or greater than about 60% and/or up to about 100% and/or up to about 95% and/or up to about 90% and/or up to about 85% and/or up to about 80% by weight on a dry fiber basis of hemicellulose, into a fiber.

Figure 2:
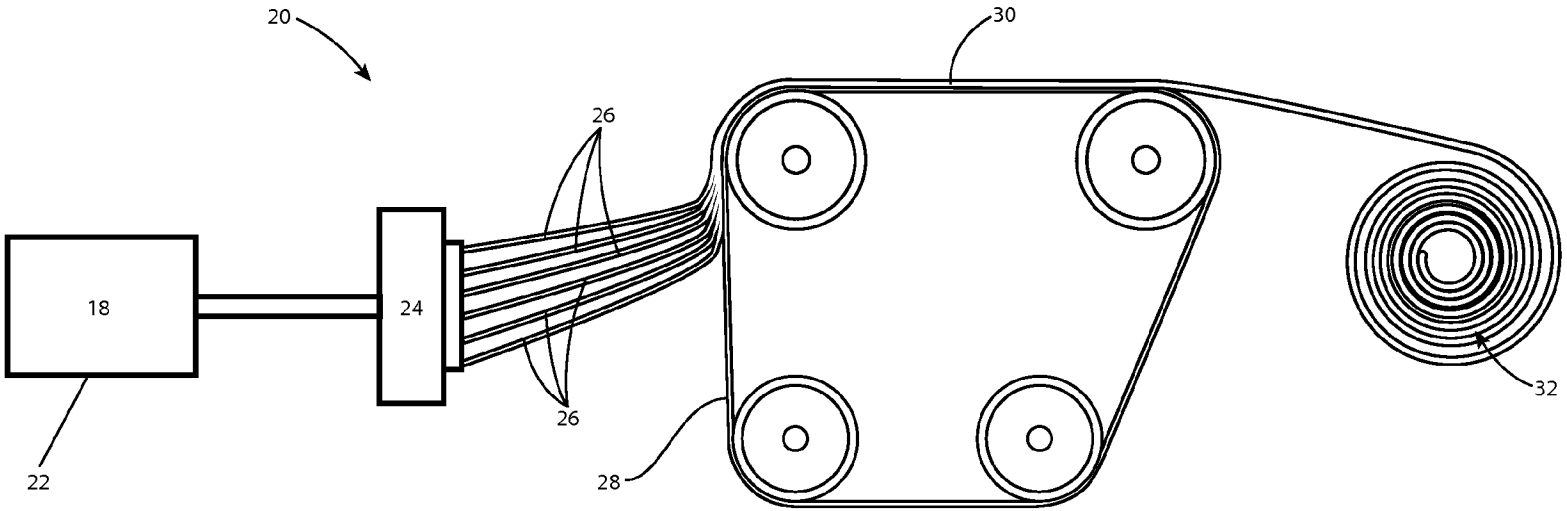
FIG. 2 is a schematic representation of one example of a process for making a fibrous structure according to the present invention.

As shown in FIG. 2, an example of a fiber spinning operation 20 comprises an extruder 22 where a hemicellulose-containing composition 18 suitable for spinning into a fiber is prepared. The hemicellulose-containing composition 18 is then transferred to a spinnerette 24. The spinnerette 24 receives the hemicellulose-containing composition 18 and then spins non-naturally occurring hemicellulose fibers 26.

Nonlimiting examples of spinning temperatures for the hemicellulose-containing composition can range from about 105° C. to about 300° C., and in some embodiments can be from about 130° C. to about 230° C. and/or from about 150° C. to about 210° C. and/or from about 150° C. to about 190° C. The spinning processing temperature is determined by the chemical nature, molecular weights and concentration of each component.

In one example, fiber spinning speeds for spinning the non-naturally occurring hemicellulose fibers is greater than about 5 m/min and/or greater than about 7 m/min and/or greater than about 10 m/min and/or greater than about 20 m/min. In another example, the fiber spinning speeds are from about 100 to about 7,000 m/min and/or from about 300 to about 3,000 m/min and/or from about 500 to about 2,000 m/min.

The non-naturally occurring hemicellulose fiber may be made by fiber spinning processes characterized by a high draw down ratio. The draw down ratio is defined as the ratio of the fiber at its maximum diameter (which is typically occurs immediately after exiting the capillary of the spinnerette in a conventional spinning process) to the final diameter of the formed fiber. The fiber draw down ratio via either staple, spunbond, or meltblown process will typically be 1.5 or greater, and can be about 5 or greater, about 10 or greater, or about 12 or greater.

In the process of spinning fibers, particularly as the temperature is increased above 105° C., typically it is desirable for residual water levels to be 1%, by weight of the fiber, or less, alternately 0.5% or less, or 0.15% or less to be present in the various components.

The spinneret capillary dimensions can vary depending upon desired fiber size and design, spinning conditions, and polymer properties. Suitable capillary dimensions include, but are not limited to, length-to-diameter ratio of 4 with a diameter of 0.35 mm.

In one example, the amount of hemicellulose-containing composition flowing through the spinnerette and being spun into fibers may be from at least about 0.1 grams/hole/minute (g/h/m) and/or from about 0.1 g/h/m to about 20 g/h/m and/or from about 0.1 g/h/m to about 15 g/h/m and/or from about 0.2 g/h/m to about 10 g/h/m and/or from about 0.2 g/h/m to about 8 g/h/m.

The residence time of the hemicellulose and/or other additives in the spinnerette and/or extruder can be varied so as to not degrade the hemicellulose and/or other additives. For example, if it is desired to add a high melting temperature thermoplastic polymer to the hemicellulose-containing composition before spinning, then the high melting temperature polymer may be subjected to a temperature for an amount of time is the absence of the hemicellulose. The hemicellulose may then be added about immediately before spinning of the hemicellulose-containing composition into a fiber.

Continuous fibers can be produced through, for example, spunbond methods or meltblowing processes. Alternately, non-continuous (staple fibers) fibers can be produced according to conventional staple fiber processes as are well known in the art. The various methods of fiber manufacturing can also be combined to produce a combination technique, as will be understood by those skilled in the art.

As will be understood by one skilled in the art, spinning of the fibers and compounding of the components can optionally be done in-line, with compounding, drying and spinning being a continuous process.

After spinning the hemicellulose-containing composition into a non-naturally occurring hemicellulose fiber, the fiber may be dried and/or crosslinked and collected on a collection belt to form a fibrous structure comprising a non-naturally occurring hemicellulose fiber.

The hemicellulose and/or additives within the fiber may be crosslinked to themselves and/or to one another.

The fibrous structure may be subjected to a post-processing operation, such as embossing, thermal bonding and/or calendaring.

d. Forming a Fibrous Structure

As shown in FIG. 2, after spinning, the non-naturally occurring hemicellulose fibers 26 are collected on a collection device, such as a belt, especially a moving belt 28, to form a fibrous structure 30. During the fibrous spinning operation 20, two or more different spinnerettes may be used to deposit non-naturally occurring fibers onto the collection device and/or onto non-naturally occurring fibers already present on the collection device 28.

The fibrous structure 30 may be subject to post-processing operations such as embossing, thermal bonding, calendaring, printing and/or tuft-generation.

The fibrous structure 30 may convolutedly wound to form a roll 32. The fibrous structure 30 may be combined with another ply of the same or different fibrous structure to form a multi-ply sanitary tissue product.

A plurality of non-naturally occurring hemicellulose fibers formed as a result of spinning a hemicellulose-containing composition according to the present invention may be collected on a collection device, such as a moving belt in order to form a fibrous structure. Other fibers may be combined with the non-naturally occurring hemicellulose fibers prior to, concurrently and/or after the non-naturally occurring hemicellulose fibers contact the collection device. The collection device may comprise a molded member that imparts a three-dimensional pattern to the fibrous structure. The three-dimensional pattern may comprise a non-random, repeating pattern.

The hemicellulose fibers of the present invention may be bonded or combined with other non-naturally occurring fibers and/or naturally occurring fibers to make fibrous structures. The non-naturally occurring fibers, such as polylactic acid fibers and/or other high molecular weight polymers, and/or naturally occurring fibers, such as cellulosic wood pulp fibers, may be associated with the fibrous structure comprising hemicellulose fibers during the forming process of hemicellulose fiber-containing fibrous structure and/or as discrete layers of non-naturally occurring fibers and/or naturally occurring fibers.

In one example, the spun hemicellulose fibers of the present invention may be collected using conventional godet winding systems and/or through air drag attenuation devices. If the godet system is used, the fibers can be further oriented through post extrusion drawing at temperatures from about 500 to about 200° C. The drawn fibers may then be crimped and/or cut to form non-continuous fibers (staple fibers) used in a carding, air-laid, or fluid-laid process.

EXAMPLES

Example 1

A hemicellulose-containing composition according to the present invention is prepared by the following procedure. A raw material source, 10 g of O-acetyl-(4-O-methylglucurono)xylan commercially available from Aldrich Chemical Company, Inc., is subjected to heat and moisture while being stirred in a jet cooking operation for 90 minutes at a temperature of about 170° C. and 90 psig. Once the hemicellulose has been solubilized and is in the form of a homogeneous hemicellulose-containing composition, then it is removed from the jet cooking operation. The hemicellulose-containing composition is now ready for spinning into a fiber.

Example 2

A hemicellulose-containing composition according to the present invention is prepared by the following procedure. A raw material source, 10 g of O-acetyl-(4-O-methylglucurono)xylan commercially available from Aldrich Chemical Company, Inc. is subjected to heat and moisture while being stirred in a jet cooking operation for 90 minutes at a temperature of about 170° C. and 90 psig. Once the hemicellulose has been solubilized, 30 parts of starch, an additive, is mixed with the hemicellulose to form a homogeneous composition. The starch is commercially available from Archer-Daniels-Midland Co. (Clinton 926-82A). The hemicellulose-containing composition is now ready for spinning into a non-naturally occurring fiber.

Example 3

A hemicellulose-containing composition according to the present invention is prepared by the following procedure. A raw material source, 10 g of O-acetyl-(4-O-methylglucurono)xylan commercially available from Aldrich Chemical Company, Inc. is subjected to heat and moisture while being stirred in a jet cooking operation for 90 minutes at a temperature of about 170° C. and 90 psig. Once the hemicellulose has been solubilized, 30 parts of glycerine, an external plasticizer, is mixed with the hemicellulose to form a homogeneous composition. The glycerine is commercially available from Dow Chemical Company (Kosher Grade BU OPTIM* Glycerine 99.7%). The hemicellulose-containing composition is now ready for spinning into a fiber.

Example 4

A hemicellulose-containing composition according to the present invention is prepared by the following procedure. A raw material source, 10 g of O-acetyl-(4-O-methylglucurono)xylan commercially available from Aldrich Chemical Company, Inc. is subjected to heat and moisture while being stirred in a jet cooking operation for 90 minutes at a temperature of about 170° C. and 90 psig. Once the hemicellulose has been solubilized, 40 parts sorbitol, an external plasticizer, is mixed with the hemicellulose to form a homogeneous composition. The sorbitol is commercially available from Archer-Daniels-Midland Co. (Crystalline NF/FCC 177440-2S). The hemicellulose-containing composition is now ready for spinning into a fiber.

Example 5

A hemicellulose-containing composition according to the present invention is prepared by the following procedure. A raw material source, 10 g of O-acetyl-(4-O-methylglucurono)xylan commercially available from Aldrich Chemical Company, Inc. is subjected to heat and moisture while being stirred in a jet cooking operation for 90 minutes at a temperature of about 170° C. and 90 psig. Once the hemicellulose has been solubilized, 30 parts sorbitol, an external plasticizer, and 20 parts polylactic acid, a high molecular weight polymer, are mixed with the hemicellulose to form a blended composition. The sorbitol is commercially available from Archer-Daniels-Midland Co. (Crystalline NF/FCC 177440-2S). The polylactic acid is commercially available from Cargill as Cargill 6200D. The hemicellulose-containing composition is now ready for spinning into a fiber.

Test Methods

Unless otherwise indicated, all tests described herein including those described under the Definitions section and the following test methods are conducted on samples that have been conditioned in a conditioned room at a temperature of 73° F.+/−4° F. (about 23° C.+/−2.2° C.) and a relative humidity of 50%+/−10% for 24 hours prior to the test. Further, all tests are conducted in such conditioned room. Tested samples and felts should be subjected to 73° F.+/−4° F. (about 23° C.+/−2.2° C.) and a relative humidity of 50%+/−10% for 24 hours prior to testing.

Hemicellulose Detection Test Method

The presence of hemicellulose in a sample, such as a fiber, a film or another structure, is determined by analyzing the sample's hexosan and/or pentosan content. For example, TAPPI Method T 223 cm-01, Pentosans (e.g., xylose, arabinopyranose, etc.) in wood and pulp, may be used to determine quantitatively the pentosan content of a fiber.

In order to determine the pentosan content of a sample, the sample is digested with acid to hydrolyze any sugar bonds within the hemicellulose of the sample to form a solution and/or dispersion. The pentosan content of the solution and/or dispersion is measured colorimetrically after adding an orcinol-ferric chloride reagent to the solution and/or dispersion.

Enzymatic Analysis Test Method

Hemicellulose content can be measured by using enzymatic analysis. For example, hemicellulose content may be analyzed using a hemicellulase enzyme (e.g., Aspergillus niger Hemicellulase, Sigma-Aldrich H2125).

Shear Viscosity of a Hemicellulose-Containing Composition Test Method

The shear viscosity of a hemicellulose-containing composition is measured using a capillary rheometer, Goettfert Rheograph 6000, manufactured by Goettfert USA of Rock Hill S.C., USA. The measurements are conducted using a capillary die having a diameter D of 1.0 mm and a length L of 30 mm (i.e., L/D=30). The die is attached to the lower end of the rheometer's 20 mm barrel, which is held at a die test temperature of 75° C. A preheated to die test temperature, 60 g sample of the hemicellulose-containing composition is loaded into the barrel section of the rheometer. Rid the sample of any entrapped air. Push the sample from the barrel through the capillary die at a set of chosen rates 1,000-10,000 seconds$^{-1}$. A shear viscosity can be calculated with the rheometer's software from the pressure drop the sample experiences as it goes from the barrel through the capillary die and the flow rate of the sample through the capillary die. The log (shear viscosity) can be plotted against log (shear rate) and the plot can be fitted by the power law, according to the formula $\eta=K\gamma^{n-1}$, wherein K is the material's viscosity constant, n is the material's thinning index and $\gamma$ is the shear rate. The reported shear viscosity of the composition herein is calculated from an interpolation to a shear rate of 3,000 $sec^{-1}$ using the power law relation.

Fiber Diameter Test Method

A fibrous structure comprising a hemicellulose fiber of appropriate basis weight (approximately 5 to 20 grams/square meter) is cut into a rectangular shape, approximately 20 mm by 35 mm. The sample is then coated using a SEM sputter coater (EMS Inc, PA, USA) with gold so as to make the fibers relatively opaque. Typical coating thickness is between 50 and 250 nm. The sample is then mounted between two standard microscope slides and compressed together using small binder clips. The sample is imaged using a 10× objective on an Olympus BHS microscope with the microscope light-collimating lens moved as far from the objective lens as possible. Images are captured using a Nikon D1 digital camera. A Glass microscope micrometer is used to calibrate the spatial distances of the images. The approximate resolution of the images is 1 μm/pixel. Images will typically show a distinct bimodal distribution in the intensity histogram corresponding to the fibers and the background. Camera adjustments or different basis weights are used to achieve an acceptable bimodal distribution. Typically 10 images per sample are taken and the image analysis results averaged.

The images are analyzed in a similar manner to that described by B. Pourdeyhimi, R. and R. Dent in "Measuring fiber diameter distribution in nonwovens" (Textile Res. J. 69(4) 233-236, 1999). Digital images are analyzed by computer using the MATLAB (Version. 6.3) and the MATLAB Image Processing Tool Box (Version 3.) The image is first converted into a grayscale. The image is then binarized into black and white pixels using a threshold value that minimizes the intraclass variance of the thresholded black and white pixels. Once the image has been binarized, the image is skeletonized to locate the center of each fiber in the image. The distance transform of the binarized image is also computed. The scalar product of the skeletonized image and the distance map provides an image whose pixel intensity is either zero or the radius of the fiber at that location. Pixels within one radius of the junction between two overlapping fibers are not counted if the distance they represent is smaller than the radius of the junction. The remaining pixels are then used to compute a length-weighted histogram of fiber diameters contained in the image.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-naturally occurring fiber comprising a blend of:

a. greater than 30% by weight on a dry fiber basis of hemicellulose;

b. a hydroxyl polymer selected from the group consisting of: cellulose, starch, polyvinyl alcohol, and mixtures thereof; and c. a high molecular weight polymer having a weight average molecular weight of greater than about 340,000 g/mol selected from the group consisting of: alginate, polyacrylamide, carboxymethylcellulose, polylactic acid, polyhydroxyalkanoate, and mixtures thereof.

2. The fiber according to claim 1 wherein the hemicellulose is obtained from wood pulp.

3. The fiber according to claim 2 wherein the wood pulp is obtained from a hardwood tree.

4. The fiber according to claim 2 wherein the wood pulp is obtained from a softwood tree.

5. The fiber according to claim 1 wherein the hemicellulose is obtained from a non-wood source.

6. The fiber according to claim 5 wherein the non-wood source is selected from the group consisting of: corn hulls, corn brans and mixtures thereof.

7. The fiber according to claim 1 wherein the hemicellulose comprises a polysaccharide comprising a monomer selected from the group consisting of: D-glucose, D-glucuronic acid, D-mannose, D-arabinose, D-xylose, D-xylopyranose, D-glucopyranose, D-galactopyranose, L-arabinofuranose, D-mannopyranose, D-glucopyranosyluronic acid, β-D-xylose, β-D-glucose, β-D-glucuronic acid, β-D-mannose, α-L-rhamnose, α-L-arabinopyranose, α-L-fucase, α-L-arabino furanose, α-D-4-O-methylglucuronic acid, α-D-galactose, α-D-galacturonic acid and mixtures thereof.

8. The fiber according to claim 1 wherein the hemicellulose comprises a polysaccharide selected from the group consisting of: xylan, glucuronoxylan, arabinoxylan, glucomannan, galactoglucomannan, xyloglucan and mixtures thereof.

9. The fiber according to claim 1 wherein the hemicellulose comprises a polysaccharide that exhibits a degree of polymerization of less than about 2000.

10. The fiber according to claim 1 wherein the hemicellulose comprises a polysaccharide having a weight average molecular weight of less than about 340,000 g/mol.

11. The fiber according to claim 1 wherein the hemicellulose is crosslinked.

12. The fiber according to claim 1 wherein the fiber further comprises a plasticizer.

13. The fiber according to claim 12 wherein the plasticizer is an external plasticizer selected from the group consisting of: water, glycerine, polyethylene glycol, sorbitol, xylitol, mannitol and mixtures thereof.

14. The fiber according to claim 1 wherein the fiber further comprises a protein.

15. The fiber according to claim 14 wherein the protein comprises a gluten-based protein.

16. The fiber according to claim 1 wherein the fiber further comprises a solid additive.

17. The fiber according to claim 16 wherein the solid additive comprises a non-hemicellulose polysaccharide microfibril.

18. The fiber according to claim 16 wherein the solid additive comprises inorganic filler.

19. A fibrous structure comprising one or more of the fibers according to claim 1.

20. A single-ply or multi-ply sanitary tissue product comprising a fibrous structure according to claim 19.

* * * * *